US007384236B2

(12) United States Patent
Meier et al.

(10) Patent No.: US 7,384,236 B2
(45) Date of Patent: Jun. 10, 2008

(54) EXHAUST-GAS-TURBINE CASING

(75) Inventors: Marcel Meier, Untersiggenthal (CH); Tobias Gwehenberger, Zürich (CH); Marcel Zehnder, Niederwil (CH); Anton Meier, Dintikon (CH)

(73) Assignee: ABB Turbo Systems AG, Baden (CH)

( * ) Notice: Subject to any disclaimer, the term of this patent is extended or adjusted under 35 U.S.C. 154(b) by 609 days.

(21) Appl. No.: 10/725,029

(22) Filed: Dec. 2, 2003

(65) Prior Publication Data

US 2004/0109755 A1 Jun. 10, 2004

(30) Foreign Application Priority Data

Dec. 2, 2002 (DE) ..... 102 56 418

(51) Int. Cl.
*F01D 25/08* (2006.01)

(52) U.S. Cl. ..... 415/178

(58) Field of Classification Search ..... 415/110, 415/134, 168.2, 174.3, 177, 178
See application file for complete search history.

(56) References Cited

U.S. PATENT DOCUMENTS 4,302,149 A * 11/1981 Smale ..... 415/134
4,679,984 A * 7/1987 Swihart et al. ..... 415/163
4,704,075 A * 11/1987 Johnston et al. ..... 417/407
5,403,150 A * 4/1995 McEachern et al. ..... 415/177
6,338,614 B1 * 1/2002 LaRue ..... 417/407

FOREIGN PATENT DOCUMENTS

| | | |
|---|---|---|
| DE | 689 06 798 | 9/1993 |
| DE | 196 48 641 | 5/1998 |
| EP | 0118051 | 9/1984 |
| EP | 0856639 | 8/1998 |

* cited by examiner

*Primary Examiner*—Edward K. Look
*Assistant Examiner*—Devin Hanan
(74) *Attorney, Agent, or Firm*—Buchanan Ingersoll & Rooney PC

(57) ABSTRACT

The exhaust-gas turbine comprises a turbine casing, a shaft rotatably mounted in a bearing housing, a turbine wheel arranged on the shaft, and a heat-protection wall, the heat-protection wall defining with the turbine casing an inflow passage leading to the turbine wheel. The heat-protection wall has two seatings, the first seating resting on the bearing housing and the second seating resting on the turbine casing.

If the heat-protection wall becomes hot, the two seatings are pressed against the bearing housing and the turbine casing. The turbine casing is pressed outward in the radial direction. Centering of the heat-protection wall and thus also of the turbine casing is ensured by the radially inner seating of the heat-protection wall.

9 Claims, 5 Drawing Sheets

EXHAUST-GAS-TURBINE CASING

BACKGROUND OF THE INVENTION

1. Field of the Invention

The present invention relates to the field of exhaust-gas-operated turbochargers. It relates to an exhaust-gas turbine, in particular a bearing housing, a turbine casing, and a heat-protection wall of an exhaust-gas turbine, the heat-protection wall, in the exhaust-gas turbine, defining with the turbine casing an inflow passage leading to the turbine wheel, the turbine wheel being arranged on a shaft rotatably mounted in the bearing housing.

2. Discussion of Background

Exhaust-gas turbochargers are used for increasing the output of internal combustion engines. Turbochargers having a turbine wheel subjected to radial flow and an inner bearing arrangement of the shaft to which the turbine wheel is attached are mainly used in the low output range up to a few megawatts.

In uncooled exhaust-gas turbochargers, in which the gas-conducting passages are not cooled, the exhaust-gas temperature at the turbine inlet is higher, as a result of which the thermal efficiency of the machine and the output delivered to the air compressor per exhaust-gas quantity increase.

The uncooled gas-inlet or turbine casing, which has a temperature of, for example, 650° C. during operation, is usually fastened directly to the bearing housing, which at 150° C., for example, is substantially cooler. In certain fields of application, the bearing housing, in contrast to the gas-conducting passages, is cooled to the aforesaid temperature. In addition, as described in EP 0 856 639, an intermediate wall serving as heat protection may be arranged in the region of an inflow passage leading to the turbine wheel, this intermediate wall shielding the bearing housing from the hot gas conducted in the inflow passage. In this case, the intermediate wall may be arranged such as to be separated from the bearing housing by an appropriate air or cooling-liquid zone and may have only a few, defined contact points in order to avoid as far as possible corresponding heat bridges to the bearing housing.

In conventional exhaust-gas turbines, straps or "profiled-clamp connections" or "V-band connections" are used in order to fasten the turbine casing to the bearing housing. In order to achieve as high an efficiency as possible, the air gap between the turbine blades and the turbine casing is to be kept as small as possible. However, this requires this casing wall and the turbine wheel to be centered relative to one another at all times, in particular during operation under full load and during corresponding thermal loading of all parts. Since the centering seat of the turbine casing relative to the bearing housing sometimes widens radially as a result of the large temperature difference between the bearing housing and the turbine casing, the turbine casing may become offset relative to the bearing housing and in particular relative to the turbine shaft mounted therein, i.e. the turbine casing is no longer centered in the radial direction relative to the shaft and the turbine wheel arranged thereon. Such an offset, which may be additionally encouraged by external actions of force, leads to contact between the turbine blade tips and the casing wall of the turbine casing, to corresponding abrasion or defects and, associated therewith, to considerable losses in efficiency of the exhaust-gas turbine.

EP 0 118 051 shows how an offset of the hotter component can be avoided by means of groove/ridge connections arranged in a star shape and movable in the radial direction.

This conventional, but relatively costly, solution approach, in which the production process, in addition to pure turning operations, also includes milling operations, only permits a restricted number of different casing positions on account of the discrete number of groove/ridge connections. However, a solution approach in which the position of the turbine casing relative to the bearing housing can be set in an essentially infinitely variable manner is desirable.

SUMMARY OF THE INVENTION

Accordingly, one object of the invention is to provide a novel exhaust-gas turbine of the type mentioned at the beginning which permits an improvement in the turbine efficiency by centering the turbine casing relative to the shaft mounted in the bearing housing.

According to the invention, this object is achieved by the characterizing features of patent claims 1, 7 and 12 and by patent claim 16.

The advantages achieved by the invention may be seen in the fact that the centering of the turbine casing relative to the shaft mounted in the bearing housing can be ensured without additional components. The bearing housing, turbine casing and heat-protection wall only need slight additional machining. As a result, no substantial additional costs arise for the exhaust-gas turbine.

The position of the turbine casing relative to the bearing housing can be set in an infinitely variable manner, since according to the invention there is no positive-locking connection between the bearing housing and the turbine casing.

This type of centering is suitable for all common types of connection between bearing housing and turbine casing, since, according to the invention, the centering is effected by components in the interior of the turbine casing.

Further advantages follow from the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
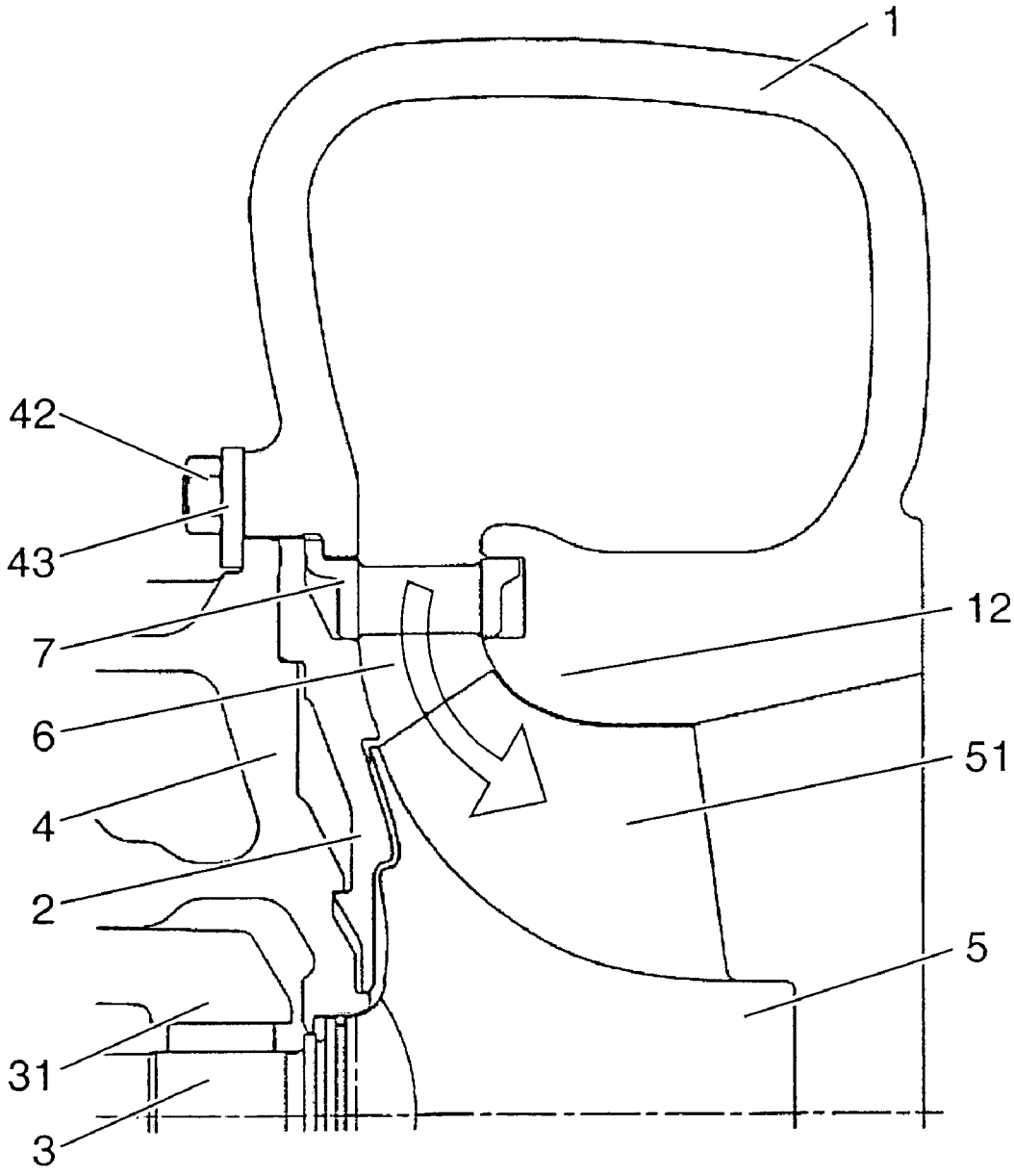
FIG. 1 shows a schematic view of a first exemplary embodiment of the exhaust-gas turbocharger according to the invention.

Referring now to the drawings, wherein like reference numerals designate identical or corresponding parts throughout the several views, the exhaust-gas turbocharger mainly comprises a compressor (not shown) and an exhaust-gas turbine schematically shown as a radial-flow turbine in FIG. 1. The exhaust-gas turbine mainly comprises a turbine casing 1, having a radially outer, spiral gas-inlet casing and a casing wall 12 on the gas outlet side, a bearing housing 4 having a shaft 3 rotatably mounted by means of bearings 31, and a turbine wheel 5 arranged on the shaft and having moving blades 51. On the compressor side, a compressor wheel (likewise not shown) is arranged on the shaft.

The gas-inlet casing merges downstream in the direction of the arrow into an inflow passage 6 for the exhaust gases of an internal combustion engine (likewise not shown) connected to the exhaust-gas turbocharger. The inflow passage is defined on one side by the casing wall 12 on the gas outlet side, whereas a disk-shaped intermediate wall 2 serving as heat protection is arranged on the other side. The heat-protection wall, which at least partly defines the inflow passage on the side of the bearing housing and/or is arranged at least partly in the axial direction between turbine wheel and bearing housing, shields the bearing housing lying behind it from the hot exhaust gases.

Furthermore, a nozzle ring 7 is arranged in the inflow passage between the heat-protection wall and the casing wall 12 on the gas outlet side.

The turbine casing 1 is secured to the bearing housing 4 by means of straps 43 in the embodiment shown, the straps, which are secured to the turbine casing with screws 42, permitting certain movements of the turbine casing relative to the bearing housing 4 in the radial direction. As can be seen from the figure, by the straps 43 being screwed tight, the heat-protection wall 2 and the nozzle ring 7 are clamped in place between turbine casing 1 and bearing housing 4 and are accordingly fixed in the axial direction. In the stationary state of the exhaust-gas turbine, when turbine casing and bearing housing are cold, the turbine casing rests on the bearing housing and is thus accordingly centered relative to the shaft and the turbine wheel arranged thereon.

Figure 2:
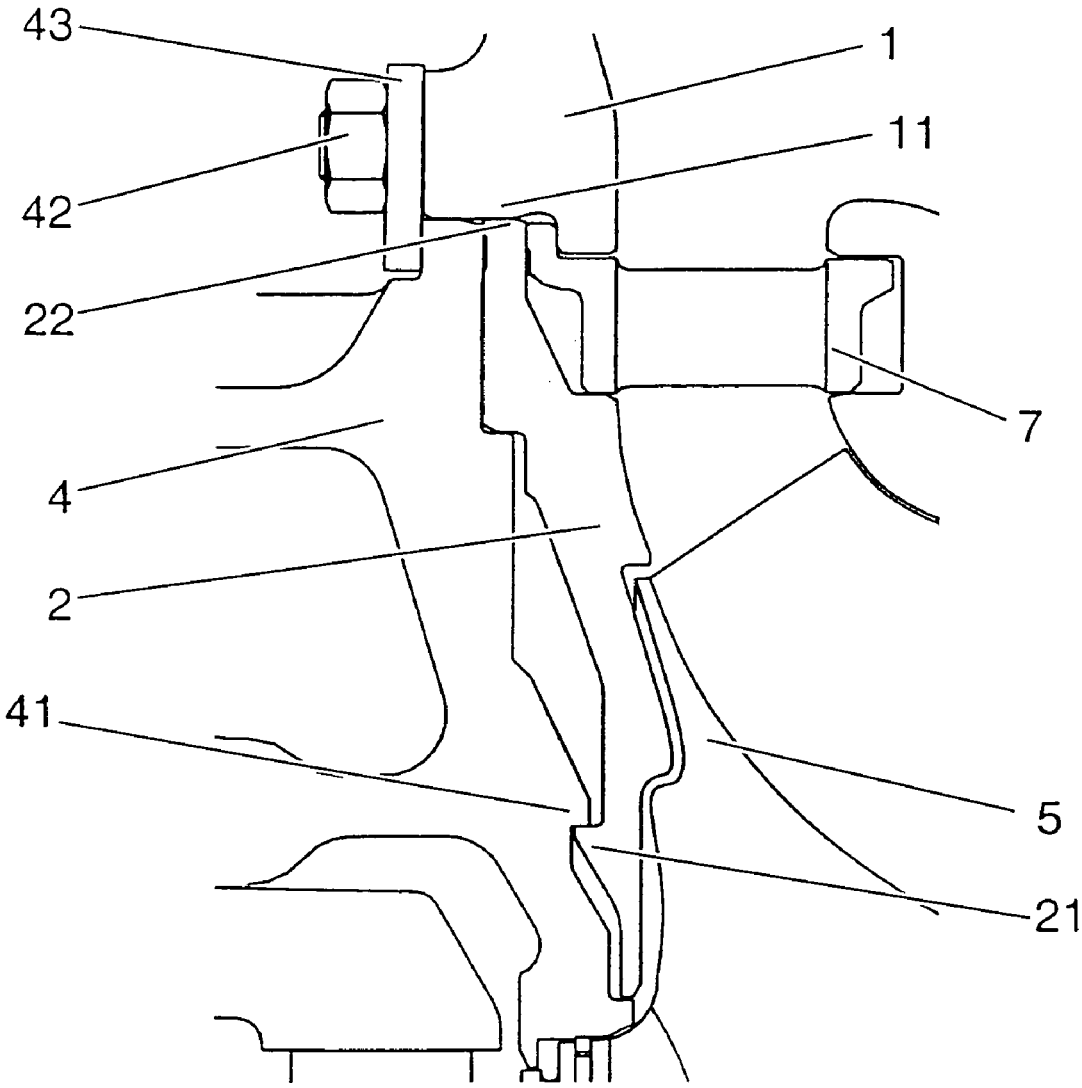
FIG. 2 shows an enlarged view of the exhaust-gas turbocharger according to FIG. 1.

In the first embodiment, shown enlarged in FIG. 2, of the exhaust-gas turbine according to the invention, a seating 21 designed as an encircling edge is arranged on the heat-protection wall 2 in the radially inner region and rests on a seating 41, likewise designed as an encircling edge, of the bearing housing. In the stationary state of the exhaust-gas turbine, when the heat-protection wall is also cold in addition to the bearing housing, there may be in each case a small air gap of a few micrometers up to several hundred micrometers between the two seatings, a factor which in particular permits simple fitting, i.e. the slipping of the heat-protection wall onto the bearing housing in the axial direction. In the radially outer region, the heat-protection wall is disposed with a radially outer seating 22 on a seating 11, directed radially inward, of the turbine casing, there likewise being a corresponding, small air gap between the two seatings in the stationary state of the exhaust-gas turbine.

In the operating state of the exhaust-gas turbine, when the heat-protection wall has a considerably higher temperature compared with the bearing housing, the heat-protection wall expands in a thermally induced manner, in particular in the radial direction. The two air gaps are reduced, in the course of which, in particular, the inner seating 21 of the heat-protection wall is pressed with great force against the corresponding seatings 41 of the cool bearing housing. The air gap between the outer seating 22 of the heat-protection wall and the seating 11 of the turbine casing can as a rule only be reduced, but not completely closed, since the turbine casing likewise expands on account of the considerable heat. Due to the radially inner seating 21 of the heat-protection wall, which bears against the seating 41 of the bearing housing, accurate centering of the heat-protection wall 2 is ensured, and accurate centering of the turbine casing 1 is also ensured thanks to the reduced outer air gap.

If a material having a higher coefficient of thermal expansion than the material of the turbine casing is selected for the heat-protection wall, the heat-protection wall expands to a greater degree than the turbine casing and presses the latter outward in the radial direction. This additionally improves the centering of the turbine casing relative to the heat-protection wall.

Figure 3:
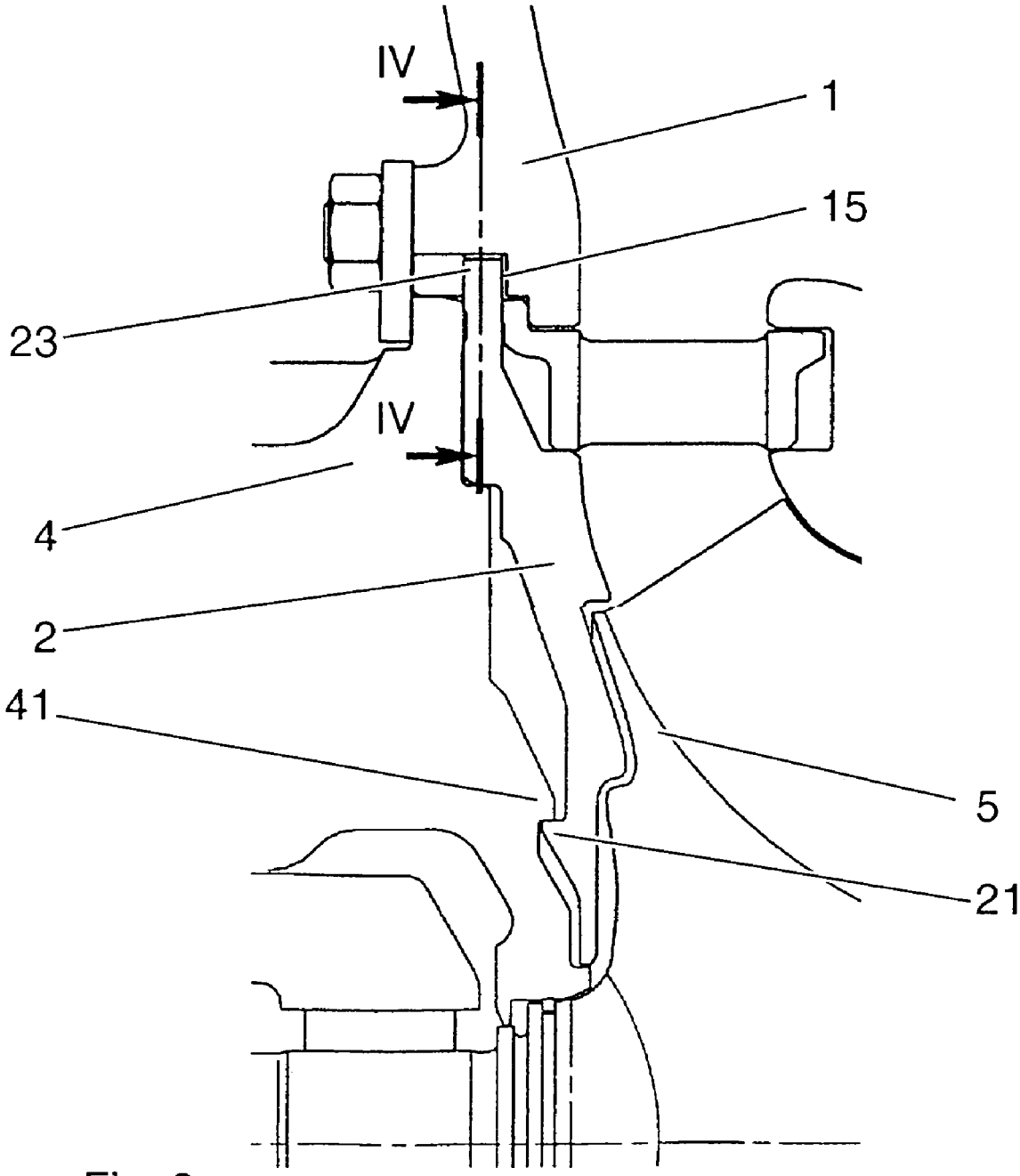
FIG. 3 shows a schematic view of a second exemplary embodiment of the exhaust-gas turbocharger according to the invention.
Figure 4:
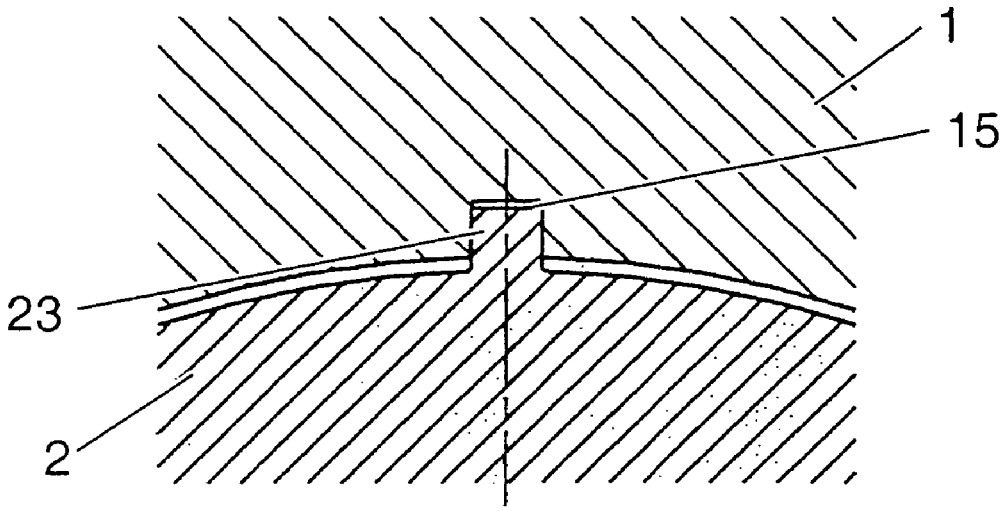
FIG. 4 shows a schematic view IV-IV from FIG. 3.

FIG. 3 and FIG. 4 show a second embodiment of the exhaust-gas turbine according to the invention. A seating 21 designed as an encircling edge is again arranged in the radially inner region and again rests on a seating 41, likewise designed as an encircling edge, of the bearing housing. In addition to or as an alternative to the simple seating 22 in the radially outer region of the heat-protection wall 2, centering lugs 23 are provided, these centering lugs 23 being arranged in a distributed manner along the circumference of the heat-protection wall. These centering lugs 23 engage in corresponding slots 15 in the turbine casing, thereby resulting in radial guidance of the turbine casing 1 relative to the heat-protection wall 2. In the stationary state of the exhaust-gas turbine, there are corresponding air gaps in particular in the region of the inner seatings, a factor which again permits simple fitting of the heat-protection wall. In this case, the heat-protection wall 2 appropriately oriented on account of the centering lugs 23 is pushed into the turbine casing 1 in the axial direction. In the operating state, the heat-protection wall again expands in the radial direction. The air gap is closed and the seating 21 of the heat-protection wall is pressed against the corresponding seating 41 of the bearing housing and accordingly centered. In the radially outer region, the centering of the turbine casing 1 is ensured by the centering lugs 23 guided in the slots 15.

Alternatively, the centering lugs may be arranged on the side of the turbine casing and the corresponding slots may be set into the heat-protection wall. Or slots may be set into both the turbine casing and the heat-protection wall, into which slots connecting wedges or plugs are pushed in the axial direction.

This second embodiment is suitable in particular in the case of very high temperatures of the turbine casing, since, owing to the radially directed slots and the centering lugs guided therein, centering of the turbine casing relative to the heat-protection wall is ensured irrespective of the thermally induced expansion of the turbine casing.

Despite this positive-locking connection between turbine casing and heat-protection wall, the position of the turbine casing relative to the bearing housing can be set in an infinitely variable manner, since there is no positive-locking connection between the heat-protection wall and the bearing housing and thus there is also no positive-locking connection between the turbine casing and the bearing housing.

Figure 6:
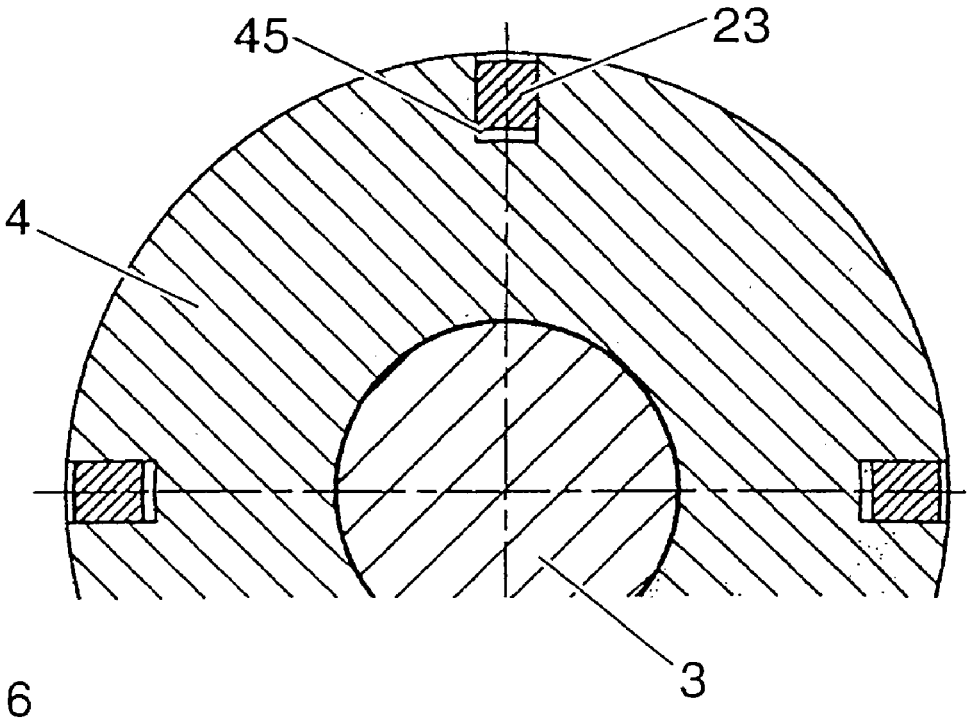
FIG. 6 shows a schematic view VI-VI from FIG. 5.
Figure 5:
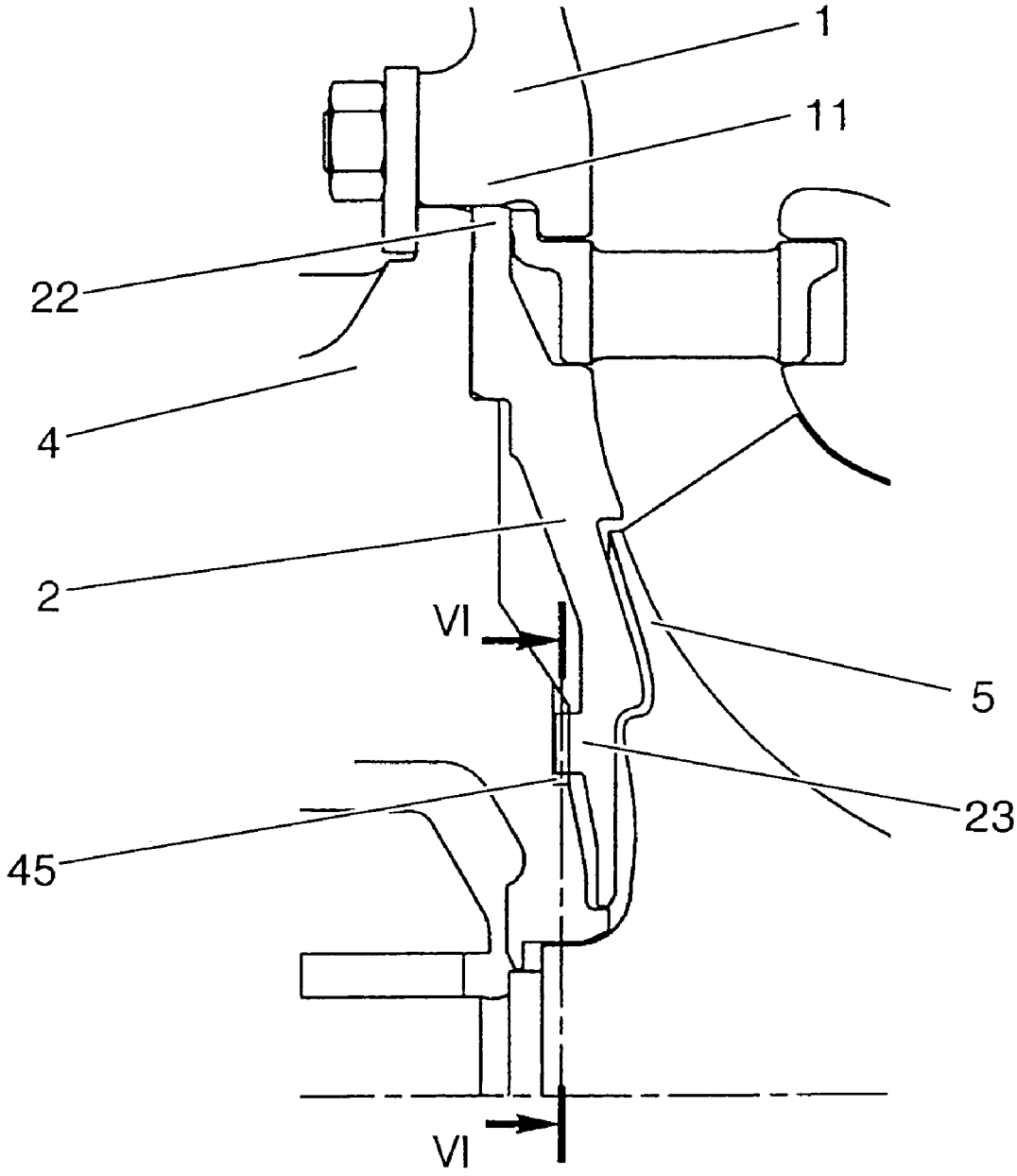
FIG. 5 shows a schematic view of a third exemplary embodiment of the exhaust-gas turbocharger according to the invention.

FIG. 5 and FIG. 6 show a third embodiment, slightly modified compared with the second embodiment, of the exhaust-gas turbine according to the invention. The centering lugs 23 are provided in the radially inner region of the heat-protection wall. In this case, the lugs 23 may be arranged on the heat-protection wall and engage in corresponding slots 45 in the bearing housing, or lugs which engage in corresponding slots in the heat-protection wall may be arranged on the bearing housing. In the latter case, the slots may be designed as through-holes or only as surface recesses in the heat-protection wall. Radial guidance of the heat-protection wall 2. relative to the bearing housing 4 is obtained. In the radially outer region, the heat-protection wall in accordance with the first embodiment is disposed with the radially outer seating 22 on the seating 11, directed radially inward, of the turbine casing, there again being a corresponding air gap in the stationary state of the exhaust-gas turbine, a factor which permits the fitting of the heat-protection wall. In this case, the heat-protection wall 2, appropriately oriented on account of the centering lugs, is pushed onto the bearing housing 4 in the axial direction. In the operating state, the heat-protection wall again expands in the radial direction. As described above, the air gap in the outer region decreases and therefore leads to corresponding centering of the turbine casing relative to the heat-protection wall. The expansion of the heat-protection wall can again be intensified by the selection of a material having a correspondingly higher coefficient of thermal expansion in order to additionally improve the centering of the turbine casing relative to the heat-protection wall. Owing to the temperature-independent centering of the heat-protection wall relative to the bearing housing by the centering lugs arranged in the inner region, this embodiment is suitable in particular for the transient operation or at low gas-inlet temperatures.

Despite the positive-locking connection between heat-protection wall and bearing housing, the position of the turbine casing relative to the bearing housing, as is already the case in the first two embodiments, can be set at any desired angle, since there is no positive-locking connection between the heat-protection wall and the turbine casing and thus there is also no positive-locking connection between the bearing housing and the turbine casing.

A suitable material for the heat-protection wall of all three embodiments would be, for example, Ni-resist, having a coefficient of thermal expansion around 30 percent higher than cast iron.

In the radially outer region of the heat-protection wall, the seating relative to the turbine casing may also be effected via an intermediate piece arranged between heat-protection wall and turbine casing, in particular via parts of the nozzle ring arranged in the inflow passage. In this case, the nozzle ring and the heat-protection wall or parts of the nozzle ring and the heat-protection wall may be produced in one piece.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters of Patent of the United States is:

1. A heat-protection wall for an exhaust-gas turbine, the exhaust-gas turbine having a turbine casing, a shaft rotatably mounted in a bearing housing, and a turbine wheel arranged on the shaft, and the heat-protection wall defining with the turbine casing an inflow passage leading to the turbine wheel, wherein the heat-protection wall has at least two seatings for centering the turbine casing relative to the shaft, a first seating of the at least two seatings being provided for resting on the bearing housing, and a second seating of the at least two seatings being provided for resting on the turbine casing; wherein at least one of the first or second seatings is designed as an encircling edge which is provided for resting on the bearing housing and/or the turbine casing;

wherein the first and second seatings are designed to be directed radially outwards.

2. An exhaust-gas turbine having a turbine casing, a shaft rotatably mounted in a bearing housing, a turbine wheel arranged on the shaft, and a heat-protection wall as claimed in claim 1, wherein an encircling edge for resting on an encircling edge of the heat-protection wall is provided on the bearing housing and/or on the turbine casing.

3. A heat-protection wall for an exhaust-gas turbine, the exhaust-gas turbine having a turbine casing, a shaft rotatably mounted in a bearing housing, and a turbine wheel arranged on the shaft, and the heat-protection wall defining with the turbine casing an inflow passage leading to the turbine wheel, wherein the heat-protection wall has at least two seatings for centering the turbine casing relative to the shaft, a first seating of the at least two seatings being provided for resting on the bearing housing, and a second seating of the at least two seatings being provided for resting on the turbine casing; and wherein slots are set into the heat-protection wall either in the region of the first seating or in the region of the second seating, which slots are provided for receiving centering lugs attached either to the bearing housing or to the turbine casing.

4. An exhaust-gas turbine, having a turbine casing, a shaft rotatably mounted in a bearing housing, a turbine wheel arranged on the shaft, and a heat-protection wall as claimed in claim 3, wherein the centering lugs which are provided for engaging in the slots which are set into the heat-protection wall are arranged either on the bearing housing or on the turbine casing.

5. A bearing housing for an exhaust-gas turbine, the exhaust-gas turbine having a turbine casing, a shaft rotatably mounted in the bearing housing, a turbine wheel arranged on the shaft, and a heat-protection wall which, in the exhaust-gas turbine, defines with the turbine casing an inflow passage leading to the turbine wheel, the heat-protection wall having means for centering the turbine casing relative to the shaft mounted in the bearing housing;

wherein the bearing housing, for centering the turbine casing via the heat-protection wall and relative to the shaft mounted in the bearing housing, has centering lugs which are provided for engaging in slots which are set into the heat-protection wall.

6. A bearing housing for an exhaust-gas turbine, the exhaust-gas turbine having a turbine casing, a shaft rotatably mounted in the bearing housing, a turbine wheel arranged on the shaft, and a heat-protection wall which, in the exhaust-gas turbine, defines with the turbine casing an inflow passage leading to the turbine wheel, the heat-protection wall having means for centering the turbine casing relative to the shaft mounted in the bearing housing;

wherein slots are set into the bearing housing for centering the turbine casing via the heat-protection wall and relative to the shaft mounted in the bearing housing, said slots extending radially and are provided for receiving centering lugs attached to the heat-protection wall.

7. A turbine casing for an exhaust-gas turbine, the exhaust-gas turbine having a bearing housing, a shaft rotatably mounted in the bearing housing, a turbine wheel arranged on the shaft, and a heat-protection wall which, in the exhaust-gas turbine, defines with the turbine casing an inflow passage leading to the turbine wheel, the heat-protection wall having means for centering the turbine casing relative to the shaft mounted in the bearing housing, wherein the turbine casing, for centering the turbine casing via the heat-protection wall and relative to the shaft mounted in the bearing housing, has centering lugs which are provided for engaging in slots which are set into the heat-protection wall.

8. A turbine casing for an exhaust-gas turbine, the exhaust-gas turbine having a bearing housing, a shaft rotatably mounted in the bearing housing, a turbine wheel arranged on the shaft, and a heat-protection wall which, in the exhaust-gas turbine, defines with the turbine casing an inflow passage leading to the turbine wheel, the heat-protection wall having means for centering the turbine casing relative to the shaft mounted in the bearing housing;

wherein slots are set into the turbine casing for centering the turbine casing via the heat-protection wall and relative to the shaft mounted in the bearing housing, said slots extending radially and being provided for receiving centering lugs attached to the heat-protection wall.

9. An exhaust-gas turbine having a turbine casing, a shaft rotatably mounted in a bearing housing, a turbine wheel arranged on the shaft, and a heat-protection wall wherein the heat-protection wall has at least two seatings for centering the turbine casing relative to the shaft, a first seating of the at least two seatings being provided for resting on the bearing housing, and a second seating of the at least two seatings being provided for resting on the turbine casing, wherein the heat-protection wall has centering lugs either in the region of the first seating or in the region of the second seating, which centering lugs are provided for engaging radially extending slots which are set into either the bearing housing or the turbine casing.

* * * * *